US006774773B2

(12) United States Patent
Funayose et al.

(10) Patent No.: US 6,774,773 B2
(45) Date of Patent: Aug. 10, 2004

(54) DISPLAY DEVICE FOR TRANSPORTATION MEANS

(75) Inventors: Yusuke Funayose, Saitama (JP); Toru Hasegawa, Saitama (JP); Tomohiko Yashiro, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 38 days.

(21) Appl. No.: 10/238,849

(22) Filed: Sep. 11, 2002

(65) Prior Publication Data

US 2003/0064642 A1 Apr. 3, 2003

(30) Foreign Application Priority Data

Sep. 18, 2001 (JP) ..... 2001-284180

(51) Int. Cl.[7] ..... B60Q 1/00

(52) U.S. Cl. ..... 340/441; 340/989; 340/438; 362/489

(58) Field of Search ..... 340/984, 986, 340/987, 438, 441, 439, 332, 331, 459, 461; 362/489, 477

(56) References Cited

U.S. PATENT DOCUMENTS 5,367,297 A * 11/1994 Yokoyama ..... 340/984
5,422,625 A * 6/1995 Sakaemura ..... 340/461
6,159,059 A 12/2000 Bernier et al.
6,441,726 B1 * 8/2002 Voto et al. ..... 340/438

* cited by examiner

*Primary Examiner*—Daryl Pope
(74) *Attorney, Agent, or Firm*—Birch, Stewart, Kolasch & Birch, LLP

(57) ABSTRACT

A jet propulsion boat is equipped with a liquid crystal display unit displaying operation information. An ordinary movement of the jet propulsion boat is regarded as an ordinary state. When the need arises for abruptly reducing the speed of the transportation means or abruptly changing the direction of the transportation means, and the like it is regarded as a non-ordinary state. The liquid crystal display unit is caused to reverse a white-and-black display thereof when the jet propulsion boat shifts from the ordinary state to the non-ordinary state. It is possible to sensitively and directly notify the driver that the transportation means is in a non-ordinary state. As a result, it becomes easier to recognize that the jet propulsion boat is in a non-ordinary state.

20 Claims, 14 Drawing Sheets

70
71
76
77
mph
0
1
2
3
4
5
6
7
8

DISPLAY DEVICE FOR TRANSPORTATION MEANS

CROSS-REFERENCE TO RELATED APPLICATIONS

This application claims priority under 35 U.S.C. §119 on Application No. 2001-284180, filed in Japan on Sep. 18, 2001, the entirety of which is hereby incorporated by reference.

BACKGROUND OF THE INVENTION

1. Field of the Invention

The present invention relates to a display device for transportation means, for example, a jet propulsion boat and the like of the form in which a jet water stream is discharged through a nozzle to thereby advance a boat hull. When the boat hull takes a turn to the left or right, a direction of the nozzle is changed by steering. In this respect, the transportation means refers to a general transportation means including ships, airplanes, railroads, vehicles and the like.

2. Description of Background Art

A jet propulsion boat obtains a propulsive force by discharging a jet water stream. The jet propulsion boat changes the direction of the jet water stream to thereby change the direction of the boat hull. Therefore, the jet propulsion boat cannot change direction without a jet water stream.

When avoiding, for example, an obstacle, a human being tends to reduce the boat speed and at the same time, to turn the steering wheel to the left or right as a general reaction. To reduce the boat speed means to close the throttle. Even though the steering wheel is turned to the left or right when the throttle has been closed, it becomes impossible to change the direction of the boat hull at will because there is no jet water stream.

As technique for complementing such a characteristic of the jet propulsion boat, there is known, for example, U.S. Pat. No. 6,159,059. The above-described technique is, according to FIGS. 2 and 3 of this document, such that one end of a throttle cable 44 is connected to a throttle regulator 46. The other end of the throttle cable 44 is connected to a throttle lever 34. A throttle return spring 49 is arranged for returning the throttle lever 34 to its original state. A compressible material 52 is arranged at the base of the throttle lever 34, whereby consideration has been given such that when the throttle lever 34 is released, the throttle regulator 46 is prevented from being abruptly closed. In addition, even when the throttle lever 34 is returned, a predetermined jet water stream can be maintained for a short while.

The above-described control type thrust steering gear for a ship mechanically controls in such a manner that when the throttle lever 34 is returned, a predetermined jet water stream can be maintained for a little while. More specifically, in a transportation means for performing such control, there is preferably a display device capable of sensitively and directly notifying the driver that the transportation means is under control.

SUMMARY OF THE INVENTION

Thus, it is an object of the present invention to provide a display device capable of sensitively and directly notifying the condition of the transportation means.

In order to achieve the above-described object, according to a first aspect of the present invention, a display device for a transportation means is equipped with a liquid crystal display unit displaying operation information. An ordinary movement of the transportation means is regarded as an ordinary state. When the need arises for abruptly reducing the speed of the transportation means or abruptly changing the direction of the transportation means, and the like, it is regarded as a non-ordinary state. A liquid crystal display unit reverses a white-and-black display thereof when the transportation means shifts from the ordinary state to the non-ordinary state.

When the transportation means shifts from the ordinary state to the non-ordinary state, and the white-and-black display of the liquid crystal display unit is reversed, to thereby sensitively and directly notify the driver that the transportation means is in a non-ordinary state.

According to a second aspect of the present invention, a display device for a transportation means includes a white-displayed portion in an ordinary state, which is caused to reverse and blink in the order of black-white-black in a non-ordinary state, and a black-displayed portion in the ordinary state is caused to reverse and blink in the order of white-black-white in the non-ordinary state. In the non-ordinary state, reversing and blinking is caused to thereby strongly give the impression on the driver that the transportation means is in the non-ordinary state.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
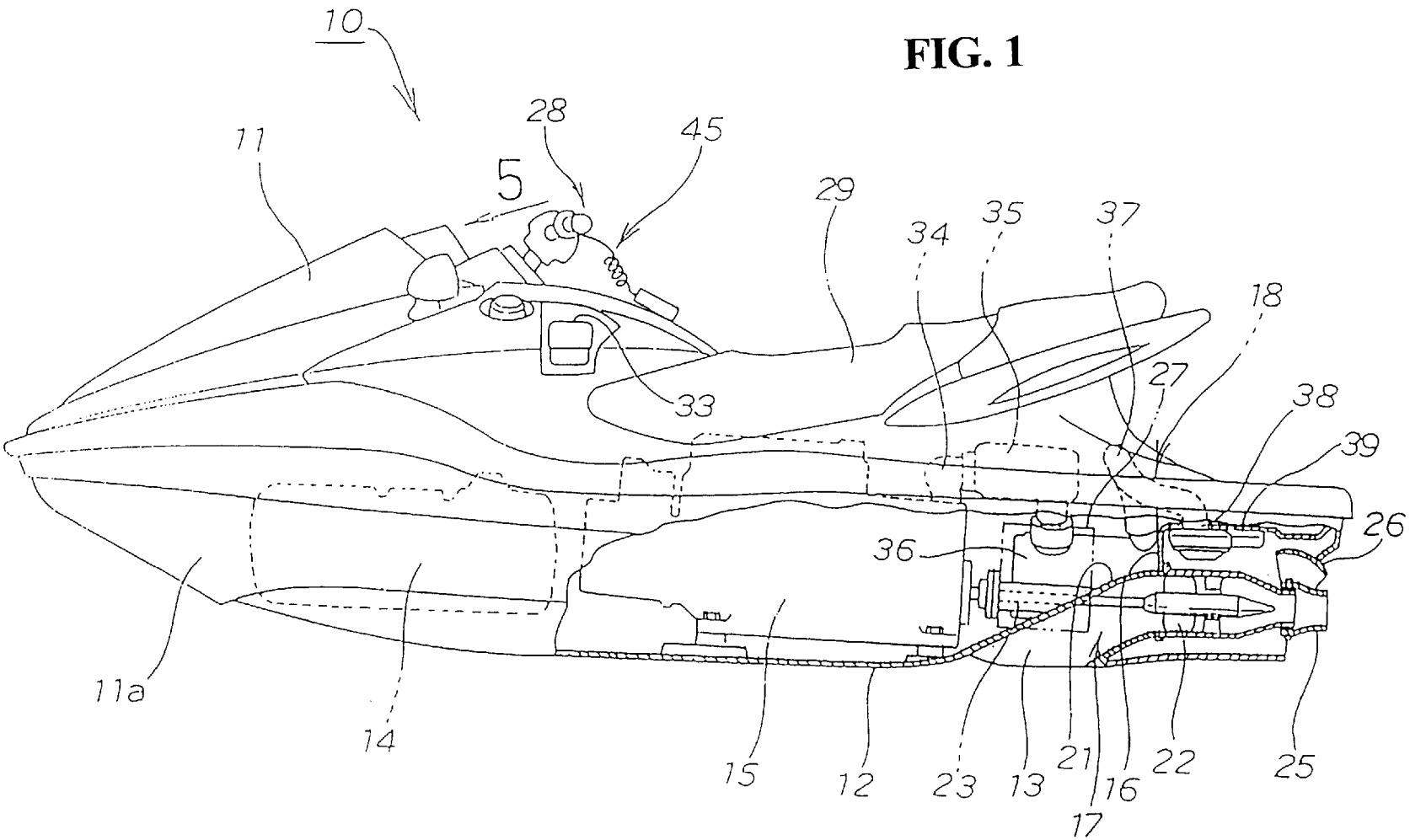
FIG. 1 is a side view showing a jet propulsion boat onto which a display device according to the present invention has been mounted.

The present invention will now be described with reference to the accompanying drawings. The drawings should be viewed in the direction of the orientation of the reference numerals.

FIG. 1 is a side view showing a jet propulsion boat onto which a display device according to the present invention has been mounted. In FIG. 1, the transportation means is a jet propulsion boat 10 which includes a fuel tank 14 mounted to a front part 11*a* of a boat hull 11. An engine 15 is provided behind this fuel tank 14. A pump chamber 16 is provided behind the engine 15, and a jet propeller 17 is provided in this pump chamber 16. An exhaust unit 18 includes a suction side mounted to the engine 15 and an exhaust side mounted to the pump chamber 16. A steering handle 28 is mounted above the fuel tank 14, and a seat 29 is mounted behind this steering handle 28.

The jet propeller 17 has a housing 21 extending backward from an opening 13 in a hull bottom 12, and is constructed such that an impeller 22 is rotatably mounted within the housing 21. The impeller 22 is coupled to a driving shaft 23 of the engine 15.

In the jet propeller 17, the engine 15 is driven to rotate the impeller 22, whereby water sucked through the opening 13 in the hull bottom 12 can be injected backward of the boat hull 11 through a steering pipe 25, which acts as a nozzle opening at a rear end of the housing 21.

The steering pipe 25 is a member mounted to the rear end of the housing 21 so as to be able to freely swing in the lateral direction. The steering pipe 25 acts as a nozzle for steering which controls the steering direction of the boat hull 11 by swinging in the lateral direction through operation of the steering handle 28.

In the jet propulsion boat 10, fuel is supplied to the engine 15 from the fuel tank 14 to drive the engine 15. A driving force of the engine 15 is transmitted to the impeller 22 through the driving shaft 23 to rotate the impeller 22, whereby water is sucked from the opening 13 in the hull bottom 12 and the water thus sucked can be injected through the steering pipe 25 through the rear end of the housing 21 for propelling.

Also, as will be described below, the jet propulsion boat 10 is a boat hull equipped with a control unit in order to precisely control an amount of the jet water stream or a duration during which the jet water stream can be injected. Furthermore, the jet propulsion boat 10 is also a boat hull capable of being switched into a limited operation mode in which the engine output can be controlled so as not to exceed a predetermined output.

In FIG. 1, reference numeral 26 designates a reverse bucket, which when reversing the boat hull, is moved over the steering pipe 25 to flow the jet water stream forward obliquely downward. Reference numeral 33 is an operating knob for operating the reverse bucket 26. Reference numeral 34 is an exhaust pipe. Reference numeral 35 is an exhaust body. Reference numeral 27 is a battery which is a power source for the boat hull 11. Reference numeral 36 is a water muffler. Reference numeral 37 is a water lock pipe. Reference numeral 38 is a tail pipe. Reference numeral 39 is a resonator. Reference numeral 45 is a main switch with a lanyard switch.

Figure 2:
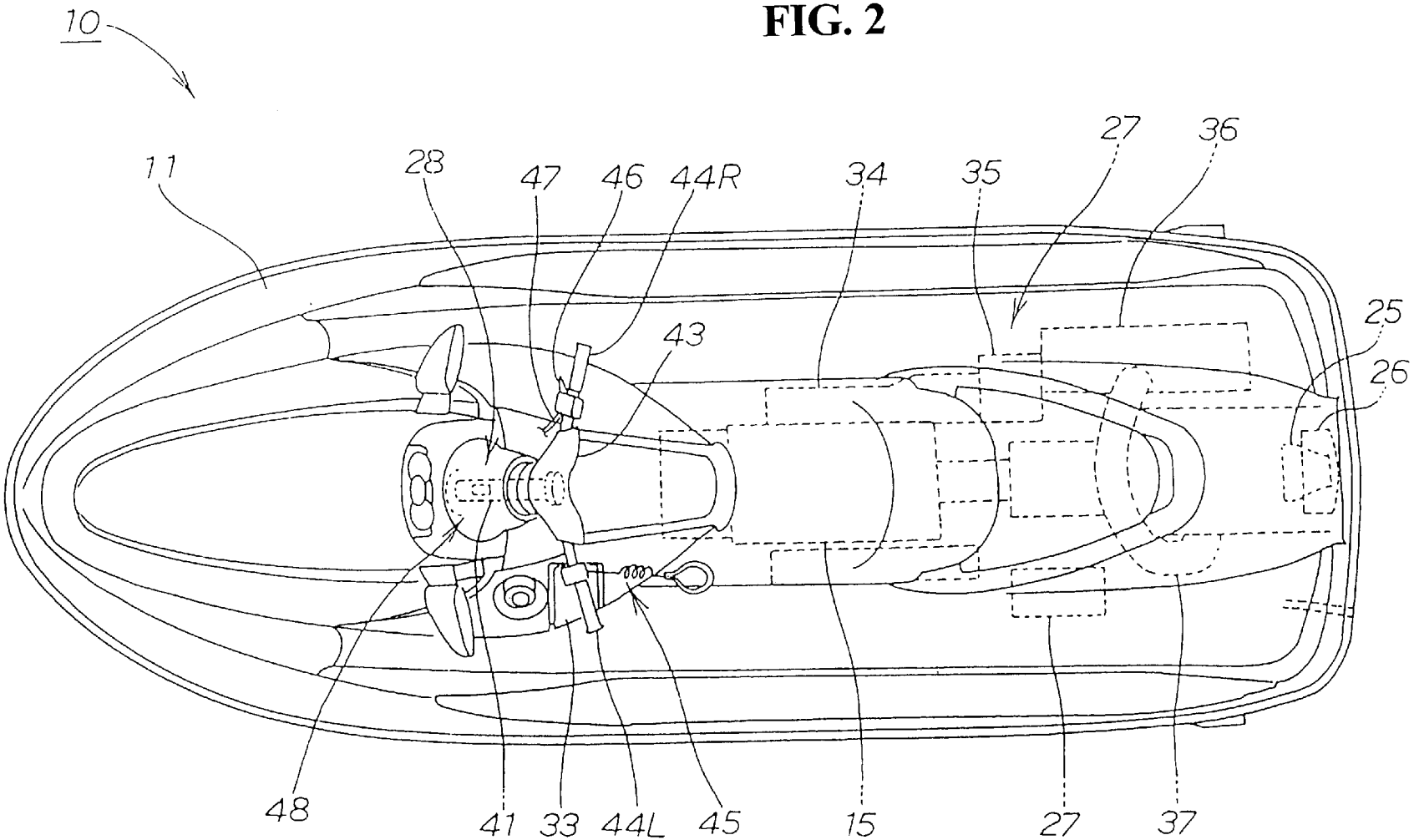
FIG. 2 is a plan view showing a jet propulsion boat onto which a display device according to the present invention has been mounted.

FIG. 2 is a plan view showing a jet propulsion boat onto which a display device according to the present invention has been mounted. The steering handle 28 includes a steering shaft 41 rotatably mounted on the boat hull. A steering wheel bar 43 is mounted to a top end of the steering shaft 41. Right and left steering wheel grips 44L, 44R are mounted onto the left and right end portions of the steering wheel bar 43. A main switch 45 with a lanyard switch is provided at the base of the left steering wheel grip 44L. A throttle lever 46 is mounted on the base of the right steering wheel grip 44R in such a manner as to be able to freely swing. A throttle cable 47 extends to the throttle from the throttle lever 46. A steering detection mechanism 48 is provided at the lower end of the steering shaft 41.

Figure 3:
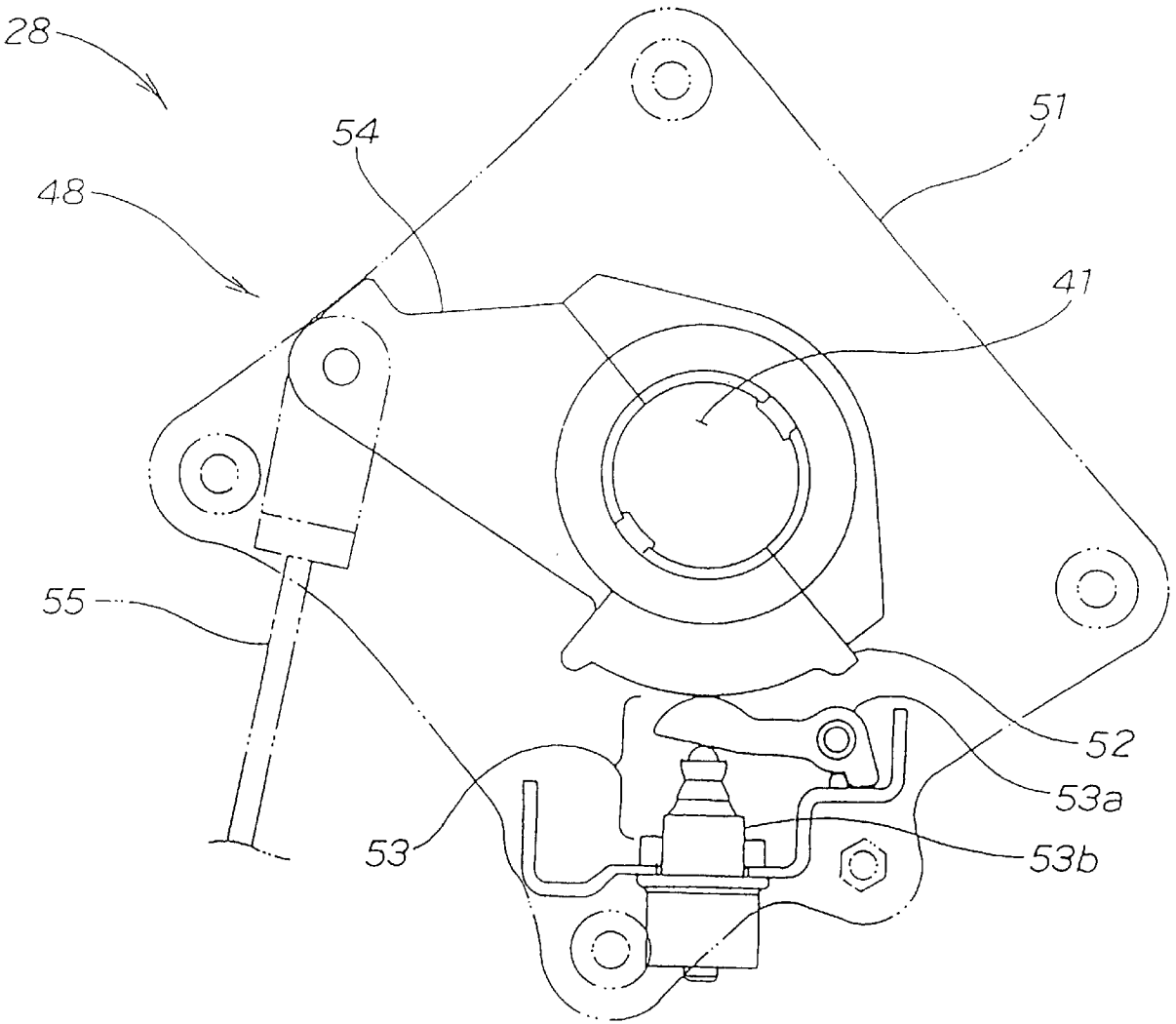
FIG. 3 is a plan view showing a steering mechanism of a jet propulsion boat onto which a display device according to the present invention has been mounted.

FIG. 3 is a plan view showing a steering mechanism for a jet propulsion boat onto which a display device according to the present invention has been mounted. The steering detection mechanism 48 includes a bracket 51 mounted on the boat hull 11 (See FIG. 1). A switch cam 52 is mounted to the lower end of the steering shaft 41. A steering switch 53 is provided for turning ON/OFF through the use of the switch cam 52. A cam plate 54 is mounted to the lower end of the steering shaft 41. In this respect, reference numeral 55 designates a driving link for driving the steering pipe 25 (See FIG. 1) by being rotatably mounted to the end portion of the cam plate 54. Reference numeral 53*a* is a switch lever for the steering switch 53, and reference numeral 53*b* is a body portion of the steering switch 53.

Figure 4:
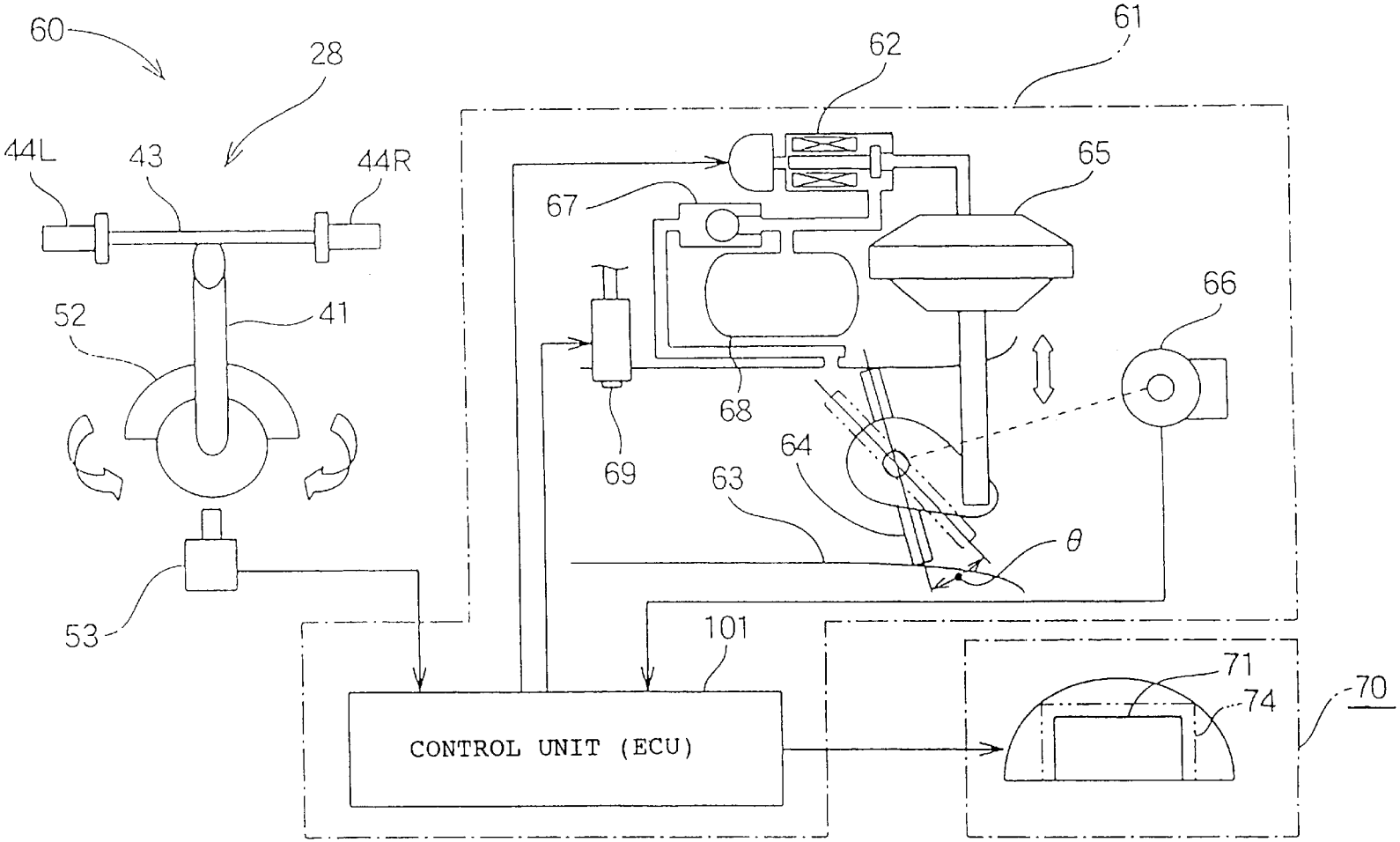
FIG. 4 is a block diagram showing an OTS control device of a jet propulsion boat onto which a display device according to the present invention has been mounted.

FIG. 4 is a block diagram showing an OTS control device for a jet propulsion boat to which a display device according to the present invention has been mounted. In this case, OTS is the abbreviated name for an off Throttle Steering System. The OTS is a device in which even when the throttle 34 has been returned, a predetermined jet water stream is rendered capable of being maintained for a predetermined period of time.

An OTS control device 60 for a jet propulsion boat is a system includes the steering handle 28 for steering the boat hull 11 (See FIG. 1). A fuel injection system 61 is provided for supplying fuel to the engine 15 (See FIG. 1). A control unit (ECU) 101 is provided for controlling the boat hull 11. A display device 70 equipped with a display control unit 74 as a control unit, is provided for displaying a state of the boat hull 11. This system is a system for raising the number of revolutions of the engine 15 to a predetermined number of revolutions irrespective of the throttle 64 when the engine 15 rotates at a predetermined number of revolutions or higher for a predetermined time period or more, and the throttle 64 is opened at a predetermined opening or more for a predetermined time period or more. In addition, if the throttle 64 is closed and at the same time, the steering wheel 28 is turned to the left or right more than a predetermined angle, the system raises the number of revolutions of the engine 15.

The fuel injection system 61 includes a solenoid 62 for controlling negative pressure on the basis of information from the control unit (ECU) 101. The throttle 64 is provided in an intake air passage 63, for adjusting an amount of an air-fuel mixture to be supplied to the engine 15 (See FIG. 1). A diaphragm 65 is provided between the solenoid 62 and the throttle 64 for adjusting a throttle opening. A throttle position sensor 66 is provided for detecting the throttle opening. A one-way valve 67 is provided between the solenoid 62 and the intake air passage 63, for preventing negative pressure from reverse-flowing, and pressure from entering. A surge tank 68 is provided between the one-way valve 67 and the solenoid 62, for relaxing negative pressure fluctuation. An injector 69 is provided for causing fuel to be in a fine spray state to be supplied to the intake air passage 63. In this figure, θ designates the throttle opening.

Figure 5:
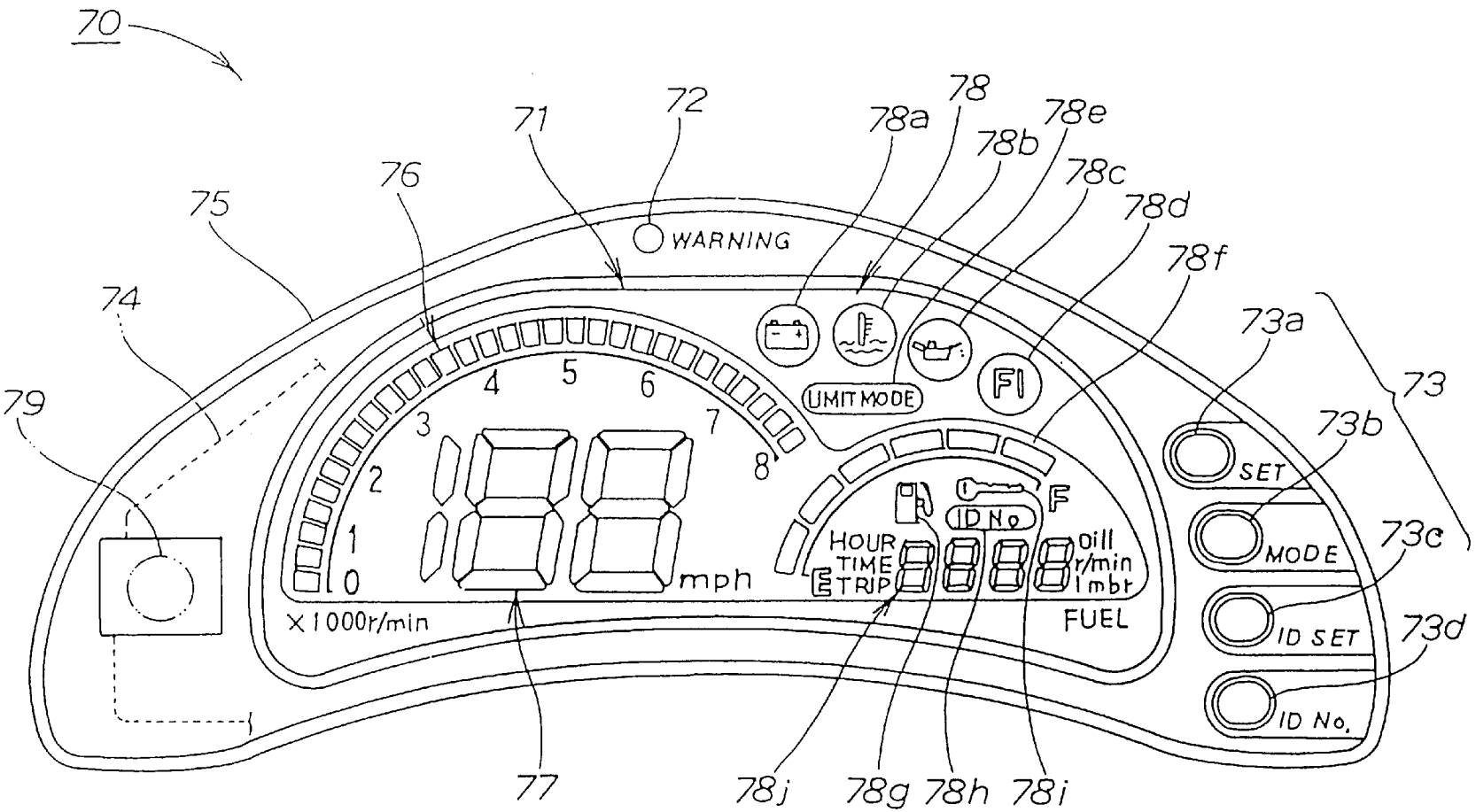
FIG. 5 is a view taken in the direction of arrow 5 of FIG. 1.

FIG. 5 is view in the direction of the arrow 5 in FIG. 1, and shows a front surface of a display device 70 (hereinafter, "display device 70") of a transportation means according to the present invention. The display device 70 includes a liquid crystal device 71 as a liquid crystal display unit for displaying operation information. A warning lamp 72 is provided for lighting or blinking when a various warning is needed. An operating switch 73 is provided for performing a switching operation or an input operation. A display control unit 74 is provided for driving the liquid crystal device 71 and the warning lamp 72 and controlling the boat hull 11. A housing 75 is provided for collectively covering the liquid crystal device 71, warning lamp 72 and display control unit 74. A buzzer 79 is provided for giving a warning sound when lighting or blinking the warning lamp 72.

The liquid crystal device 71 is obtained by forming a tachometer 76 for indicating a number of revolutions of the engine 15 (See FIG. 1), a speed meter 77 for indicating the boat speed, and a multifunctional display unit 78 for displaying operation information and various warnings.

The multifunctional display unit 78 includes a charging mark 78*a* for blinking when the battery 27 (See FIG. 1) is lower than predetermined voltage. A water temperature warning mark 78*b* is provided for blinking when cooling water temperature exceeds a predetermined temperature. An oil warning mark 78*c* is provided for blinking when an amount of engine oil is lower than a predetermine amount, or when engine oil pressure is lower than a predetermined value. A fuel injection system warning mark 78*d* (hereinafter, will be abbreviated as "Fl warning mark 78*d*") is provided for blinking when abnormal conditions are encountered with the fuel injection system 61 (See FIG. 3). A limit mode indicating mark 78*e* is provided as an indicating lamp indicating that a limited operation mode, which limits the engine output so as not to exceed the predetermined output has been set. A remaining quantity indicator 78*f* is provided for indicating the remaining fuel quantity. A fuel replenish warning mark 78*g* is provided for urging to replenish fuel when the remaining fuel quantity is small. An ID number mark 78*h* is provided for blinking when an ID (Identification) number as a secret number for theft prevention is set and is locked. A key mark 78*i* is provided for lighting when the theft-prevention function has been released. A selector display unit 78*j* is provided for displaying after being switched to time indication, hours underway indication, the number of engine revolutions (hereinafter, will abbreviated as "Ne tacho-indication"), navigation distance indication or cumulative hours underway indication.

In other words, the jet propulsion boat 10 (See FIG. 1) is also a propulsion boat equipped with a theft-prevention function, the power source of which can be turned ON or OFF by inputting the ID number.

The operating switch 73 includes a set switch 73*a* to be used when setting time and the like. The mode switch 73*b* is used when switching the selector display unit or when setting the limited operation mode. The ID set switch 73*c* and the ID number switch 73*d* are used when encoding with an ID number for determination.

Figure 6:
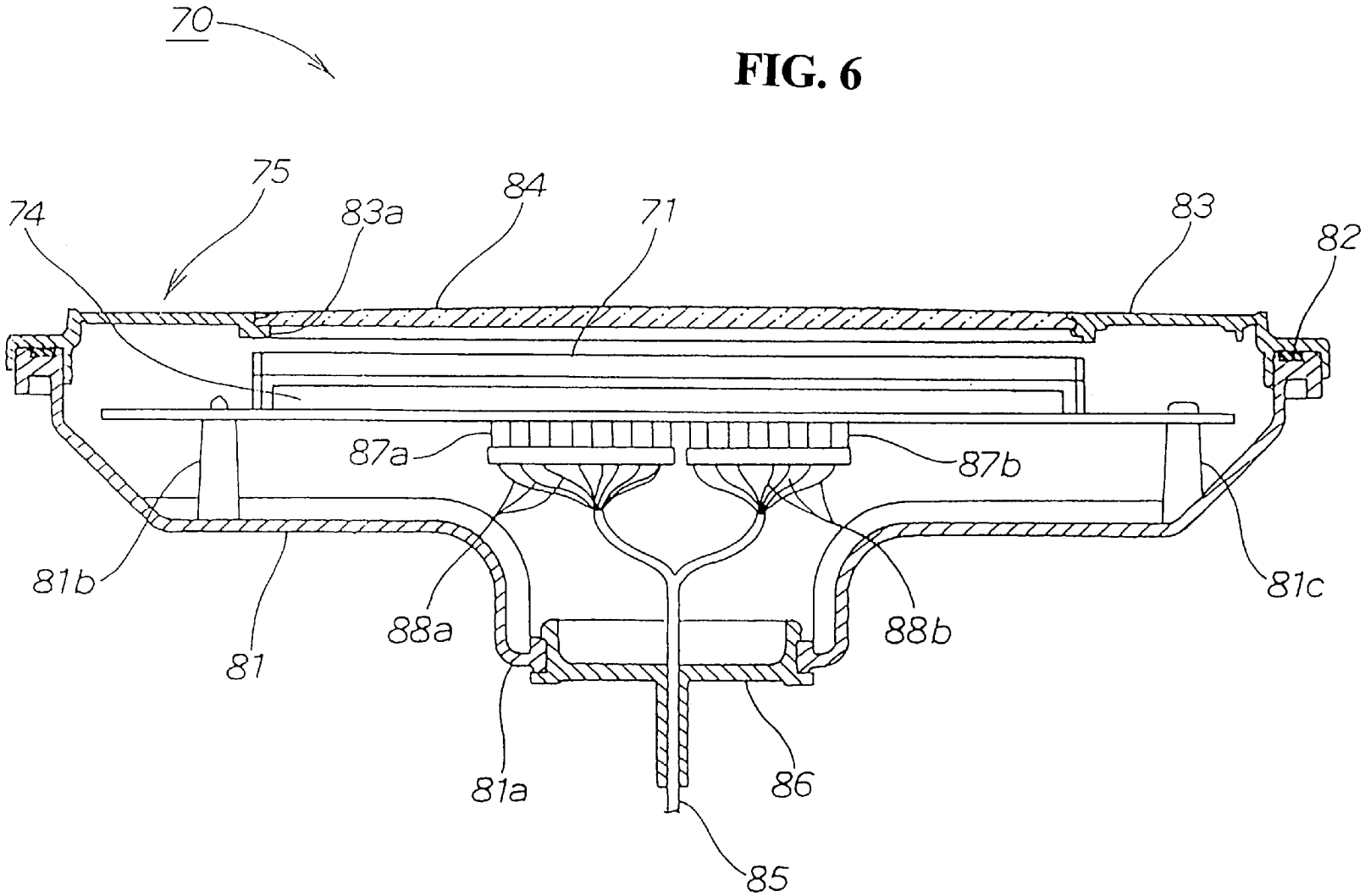
FIG. 6 is a plan cross-sectional view showing a display device for a transportation means according to the present invention.

FIG. 6 is a plan cross-sectional view showing a display device of the transportation means according to the present invention. A housing 75 includes a lower case 81 for mounting a display control unit 74. An upper case 83 is mounted to the lower case 81 through a packing 82. A display window 84 is mounted onto an opening 83*a* of the upper case 83. A bush 86 is provided to draw out a harness 85 obtained by tying up in a bundle from the bottom 81*a* of the lower case 81.

Reference numeral 81*b* designates a boss for supporting the display control unit 74 by standing it in the lower case 81. Reference numeral 81*c* is a set boss for fastening the display control unit 74 by standing it in the lower case 81. Reference numerals 87*a* and 87*b* are connectors connected to the display control unit 74. Reference numerals 88*a* and 88*b* are a plurality of harnesses extending from the display control unit 74.

Figure 7:
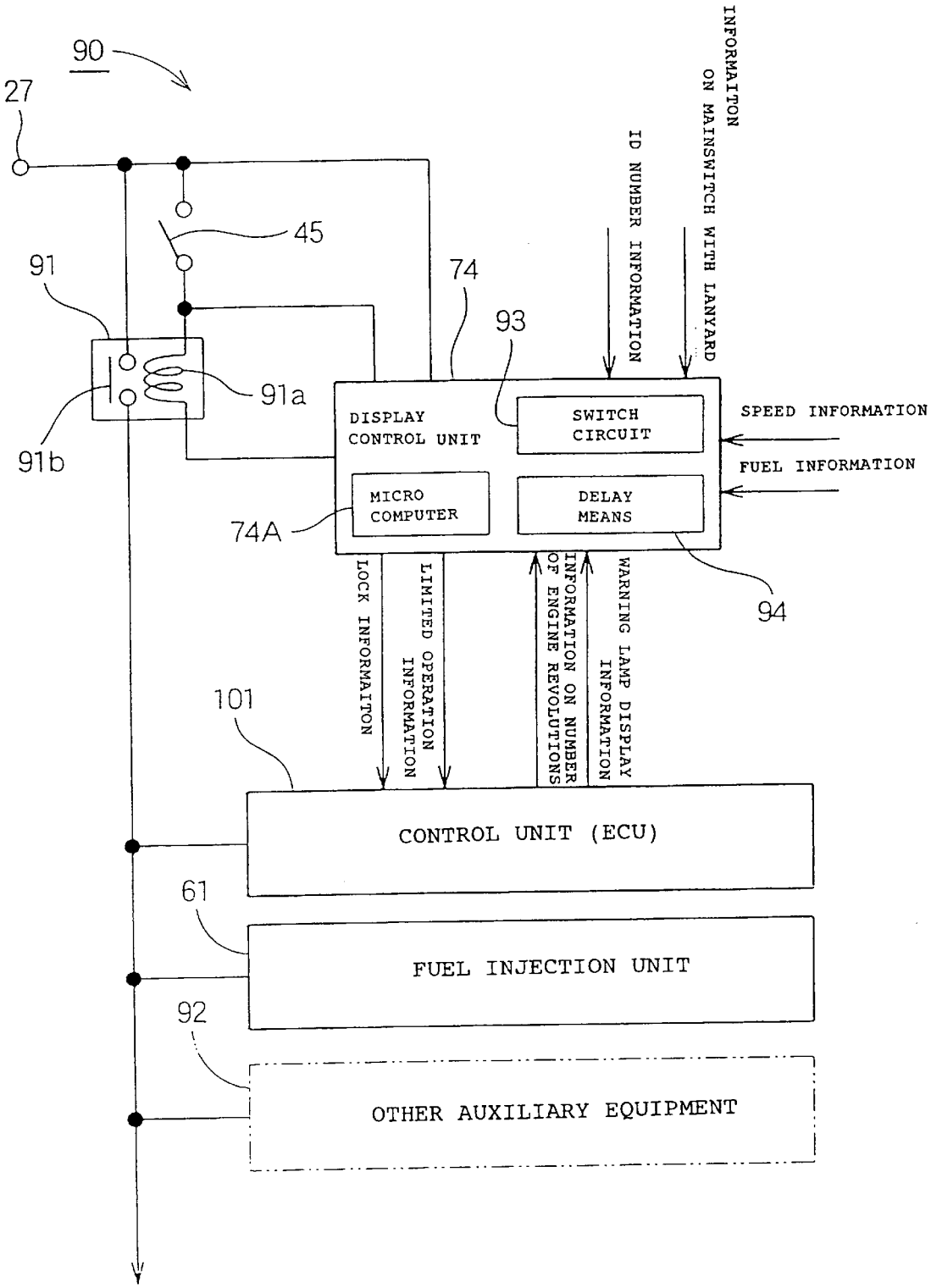
FIG. 7 is a block diagram showing a power source system for a jet propulsion boat onto which a display device according to the present invention has been mounted.

FIG. 7 is a block diagram showing a power source system for a jet propulsion boat onto which a display device according to the present invention has been mounted. The power source system 90 includes a main switch 45 with a lanyard switch connected to a battery 27 in parallel. A main relay 91 is provided for turning ON/OFF the battery 27 for supplying to the fuel injection system 61 and other accessories 92 (fuel pump to be described later) by connecting a coil portion 91*a* to the main switch 45 in series and connecting a switch portion 91*b* to the battery 27 in series. The display control unit 74 connects to the main switch 45 in parallel in order to control the main relay 91. The control unit (ECU) 101 is provided for controlling the engine 15 (See FIG. 1) having the fuel injection system 61 and the like.

The control unit (ECU) 101 is a portion which controls the engine 15 and controls the jet propulsion boat 10 (See FIG. 1) which controls the fuel injection system 61 and other accessories 92.

The display control unit 74 is equipped with a microcomputer 74A which forms the heart of the system. A switch circuit 93 turns ON/OFF the power source of the display control unit 74 itself by inputting information of the main switch 45 with lanyard switch and a predetermined ID number. Delay means 94 is provided for delaying the operation of the switch circuit 93 for a predetermined time period. The delay means 94 inputs ID information for theft prevention, information of the main switch with lanyard switch, speed information of the boat hull, fuel information for displaying the remaining fuel quantity, engine number of revolutions information, and warning lamp display information and the like for lighting the multifunctional function display unit 78 shown in FIG. 5 and the warning lamp 72, and outputs limited operation information when the fuel injection system 61 (See FIG. 4) is controlled for control operation, and lock information which has turned OFF the main relay 91, and the like. In this respect, a reference numeral 92 designates other accessories.

In other words, a power source system for a small boat supplies a power source to accessories including the fuel injection system 61, and the like, and is equipped with a control unit for controlling the engine. The small boat is equipped with the main switch 45 with a lanyard switch capable of turning OFF the power source in an emergency by connecting to an occupant through a wire. The power source system 90 is equipped with a main relay 91 for turning ON/OFF the power source to be supplied to the accessories. Control units (display control unit 74) are connected to the main switch 45 in parallel in order to control the main relay 91, to supervise the ON/OFF state of the main switch 45, through the use of the control unit (display control unit 74) and to ON/OFF control the main relay 91 based on the ON/OFF state.

The structure is arranged such that the main relay 91 is provided in order to turn ON/OFF the power source to be supplied to the accessories including the fuel injection system 61. control units (display control unit 74) are provided in order to control this main relay 91. The control units (display control unit 74) are to be connected to the main switch 45 in parallel. An ON/OFF state of the main switch 45 is supervised by the control unit (display control unit 74) in such a manner that the main relay 91 is turned ON/OFF on the basis of the ON/OFF state. Therefore, ON/OFF of the power source to be supplied to the accessories including the fuel injection system 61 can be collectively controlled. As a result, the power source system 90 can be simplified.

Also, the display control unit 74 outputs to the control unit (ECU) 101 lock information when the main relay 91 is OFF. Therefore, since the control unit (ECU) 101 has the lock information, the engine 15 (See FIG. 1) cannot be started even though the main relay 91 is directly connected.

More specifically, the power source system 90 includes a theft-prevention function in the control unit (display control unit 74). When the control unit (ECU) 101 outputs information to turn OFF the main relay 91 from the control unit (display control unit 74), it is caused to output a stop signal to stop the engine 15 on the basis of this OFF signal.

When information to turn OFF the main relay 91 is outputted from the control unit (display control unit 74), the stop signal to stop the engine 15 is outputted on the basis of this OFF signal, whereby there is no possibility that the engine 15 is started even when, for example, the main relay 91 is directly coupled. Therefore, it is possible to prevent the small boat (jet propulsion boat 10) from being stolen.

Figure 8:
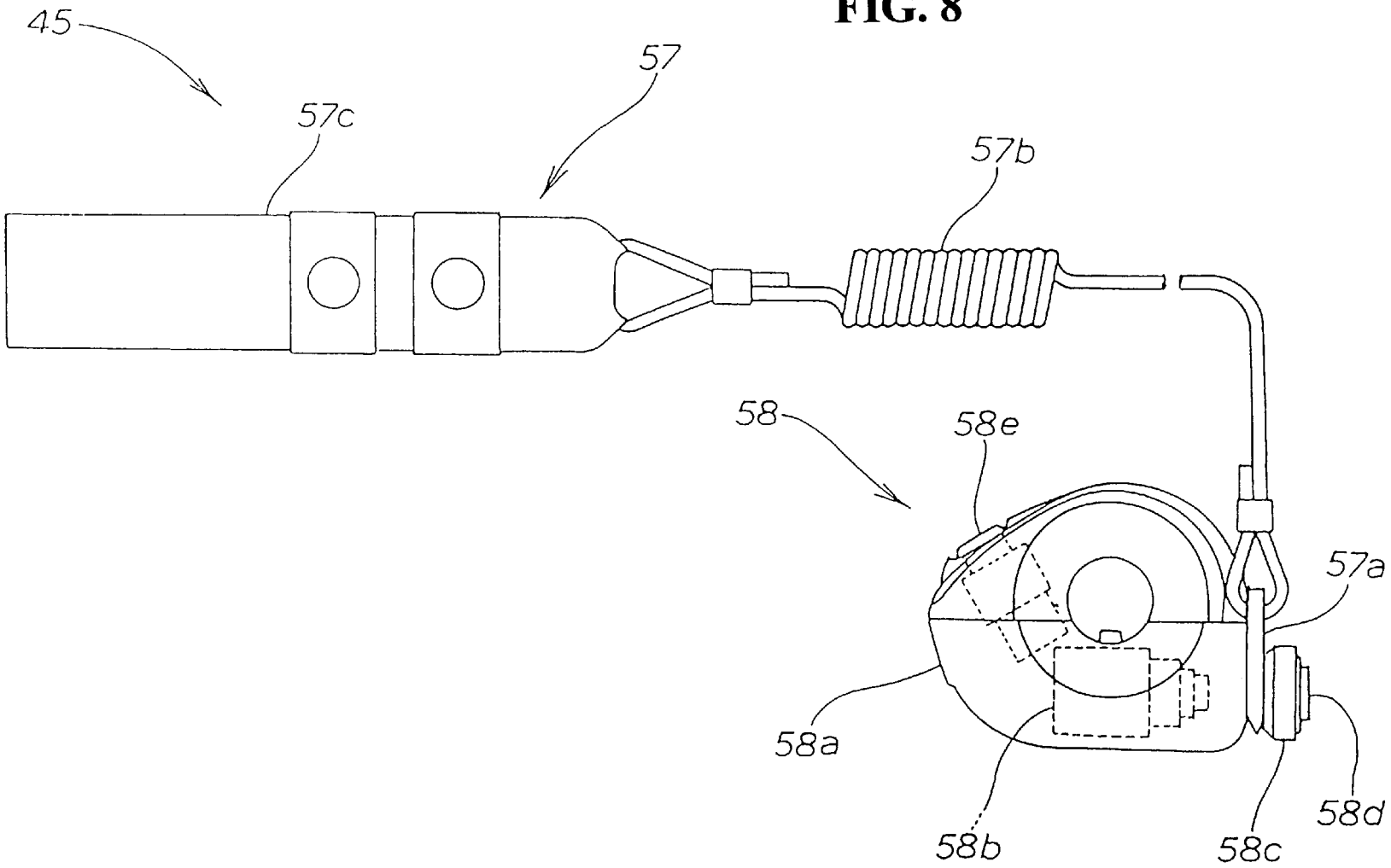
FIG. 8 is a side view showing a main switch with a lanyard switch for a jet propulsion boat onto which a display device according to the present invention has been mounted.

FIG. 8 is a side view showing a main switch with a lanyard switch of a jet propulsion boat onto which a display device according to the present invention has been mounted. The main switch 45 includes a lanyard switch portion (switch operation strap) 57 for being connected to the occupant during navigation and a main switch body portion 58 capable of being turned ON/OFF by the lanyard switch portion 57.

The lanyard switch portion 57 includes a clip portion 57*a* for turning the power source ON/OFF by sandwiching it in the main switch body portion 58 or removing it. A flexible wire 57*b* extends from the clip 57*a* and a hand strap 57*c* is provided to be worn on the occupant's arm by mounting to the tip end of the wire 57*b*.

The main switch portion 58 includes a housing 58*a* for being mounted on the boat hull 11 (See FIG. 1). A switch 58*b* is housed in this housing 58*a*. An outer knob 58*c* is provided for operating the switch 58*b*. A stop button 58*d* is provided inside the outer knob 58*c* and a start switch 58*e* is provided for starting the engine 15 (See FIG. 1).

This switch turns the switch 58*b* ON when the outer knob 58*c* is pulled outward, maintains the switch ON when the clip 57*a* of the lanyard switch portion 57 is sandwiched, automatically returns to the initial position to turn the switch OFF when the clip 57*d* comes off, and can turn the power source OFF by pressing the stop button 58*d* with the clip 57*a* sandwiched. Hereinafter, the detailed description will be made of an operation of the main switch 45 with the lanyard switch.

Figure 9A:
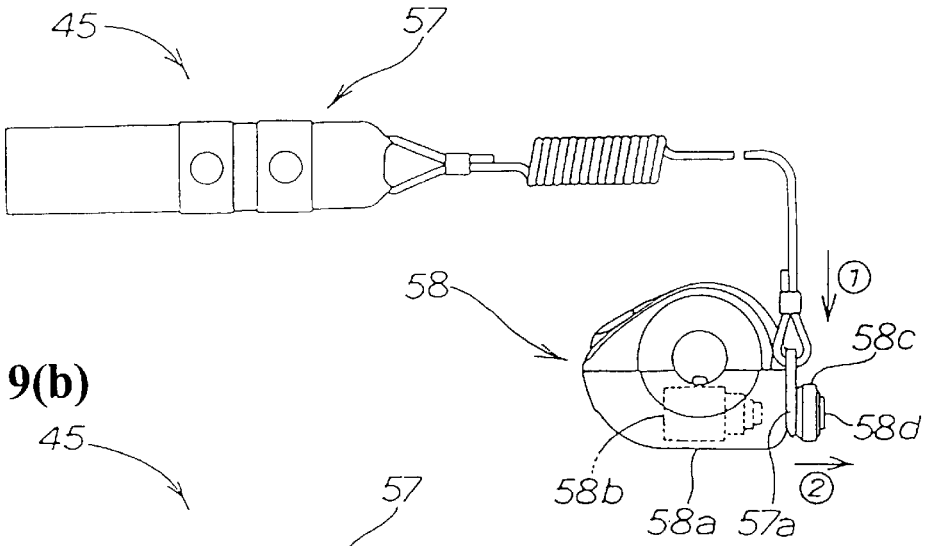
FIG. 9 is an operation view showing a main switch with lanyard switch for a jet propulsion boat onto which a display device according to the present invention has been mounted.
Figure 9B:
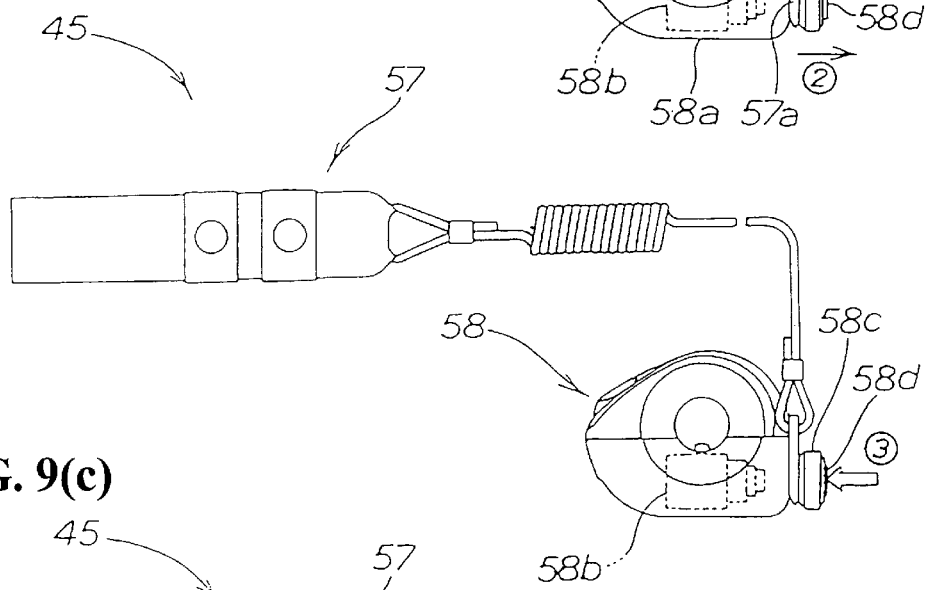
Figure 9C:
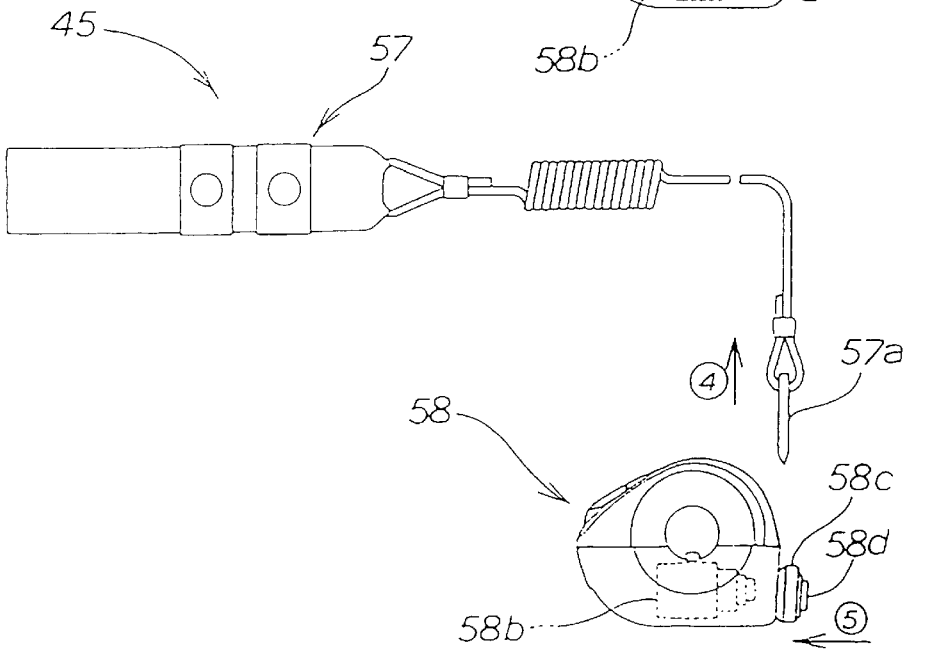

FIGS. 9(*a*) to 9(*c*) are operating views of the main switch with a lanyard switch for a jet propulsion boat onto which a display device according to the present invention has been mounted.

In FIG. 9(*a*), the clip 57*a* of the lanyard switch portion 57 is pressed into between the housing 58*a* of the main switch body portion 58 and the outer knob 58*c* as indicated by an arrow ①, whereby the outer knob 58*c* moves as indicated by an arrow ②, and the switch 58*b* can be turned ON.

In FIG. 9(*b*), the stop button 58*d* is pressed as indicated by an arrow ③ with the lanyard switch portion 57 fitted in the main switch body portion 58, whereby the switch 58*b* can be turned OFF.

In FIG. 9(*c*), when the clip 57*a* of the lanyard switch portion 57 is pulled out between the housing 58*a* of the main switch body portion 58 and the outer knob 58*c* as indicated by an arrow ④, the outer knob 58*c* automatically returns together with the stop button 58*d* as indicated by an arrow ⑤, and the main switch body portion 58*b* turns OFE Hereinafter, the description will be made of a control flow of the jet propulsion boat 10.

Figure 10:
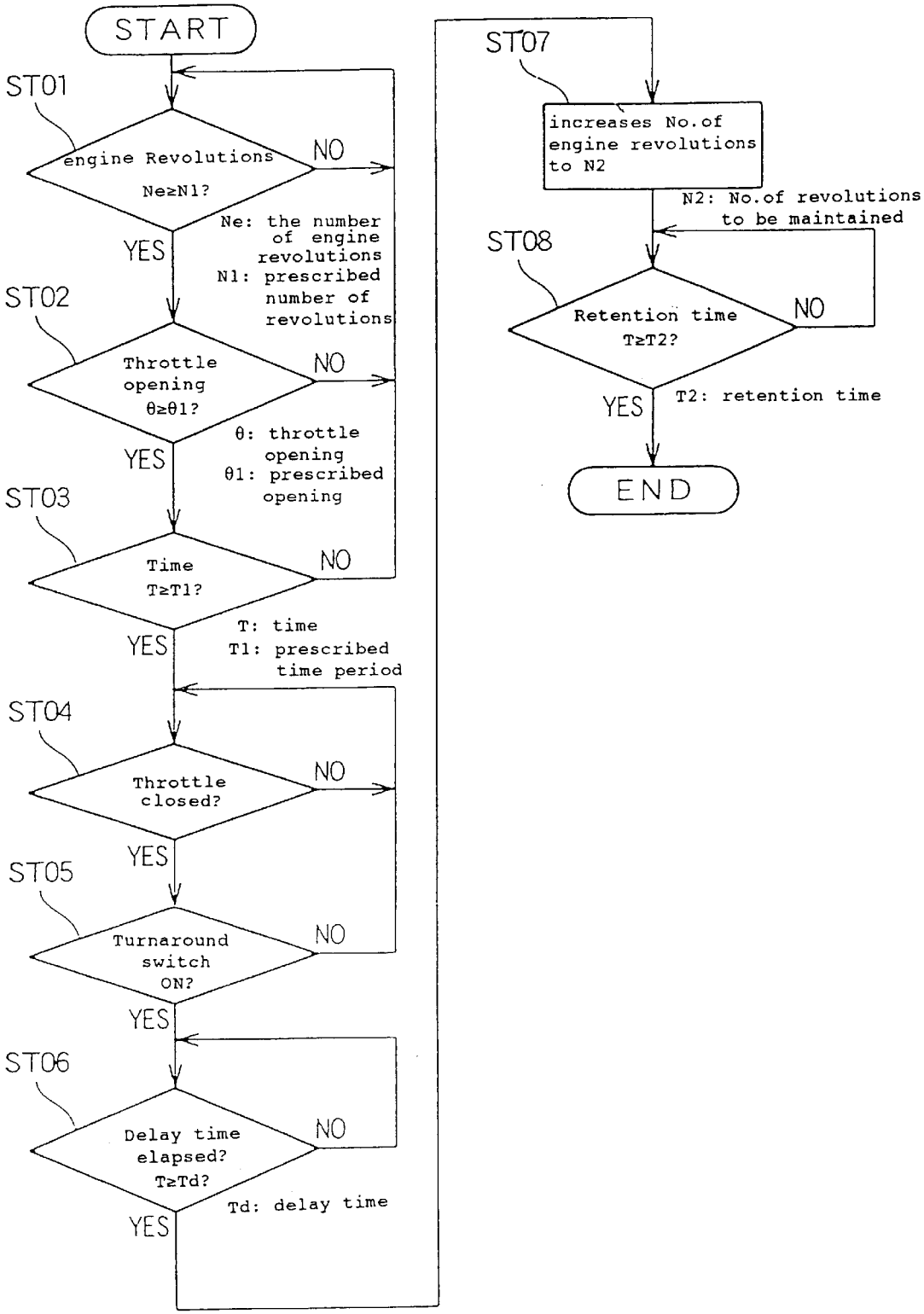
FIG. 10 is a control flow chart for a jet propulsion boat onto which a display device according to the present invention has been mounted.

FIG. 10 is a control flow diagram for a jet propulsion boat according to the present invention. In this respect, STxx designates a step No. (for symbols, refer to FIG. 4)

ST01: Assuming the number of revolutions of an engine to be Ne, and that of a predetermined engine to be N1 (hereinafter, it will be described as "predetermined number of revolutions N1"), it is examined whether or not the number of revolutions of an engine Ne exceeds the predetermined number of revolutions N1 (Ne≧N1). If YES, the sequence will proceed to ST02, and if NO, the sequence will return to the start. In this case, the predetermined number of revolutions N1 is set to 3,700 rpm.

ST02: Assuming a throttle opening to be θ, and a predetermined throttle opening to be θ1 (hereinafter, it will be described as "predetermined opening θ1"), it is examined whether or not the throttle opening θ exceeds the predetermined opening θ1. If YES, the sequence will proceed to ST03, and if NO, the sequence will return to the ST01. In this case, the predetermined opening θ1 is set to 13°.

ST03: Assuming a time period to be T, and a predetermined time period to be T1, it is examined whether or not both a state of the predetermined number of revolutions N1 or higher and a state of the predetermined opening θ1 or larger exceed the predetermined time period T1. If YES, the sequence will proceed to ST04, and if NO, the sequence will return to the ST01. In this case, the predetermined time period T1 is set to 2 sec.

ST04: It is examined whether or not the throttle 64 has been closed (throttle opening θ=0). If YES, the sequence will proceed to ST05, and if NO, the ST04 will be repeated.

ST05: Has a steering switch 53 turned ON? If YES, the sequence will proceed to ST06, and if NO, the sequence will return to ST04.

ST06: Assuming the predetermined delay time to be Td, has the delay time Td elapsed (T≧Td)? In this case, the delay time Td is set to 0.7 sec. If YES, the sequence will proceed to ST07, and if NO, the ST06 will be repeated.

ST07: Assuming the predetermined maintenance number of revolutions to be N2, the engine number of revolutions Ne is raised to the maintenance number of revolutions N2 to maintain the number of revolutions. In this case, the maintenance number of revolutions N2 is set to 2100 rpm.

ST08: Assuming the predetermined maintenance time to be T2, has the maintenance time T2 elapsed? If YES, the step will be completed, and if NO, the ST08 will be repeated. In this case, the maintenance time T2 is set to 7 sec.

In other words, a jet propulsion boat includes a jet water stream caused by a jet propeller 17 having an engine 15 as a driving source. The jet water stream is caused to be discharged through a steering pipe 25 (nozzle), whereby the boat hull 11 is caused to advance. When the boat hull 11 makes a turn to the left or right, the direction of the nozzle is changed by the steering handle 28. The jet propulsion boat 10 (See FIG. 1) is equipped with a control unit 74 (See FIG. 4) for raising the number of revolutions of the engine to a predetermined number of revolutions (maintenance number of revolutions N2) irrespective of the throttle 64. At the same time, the control unit maintains the same number of revolutions only for a predetermined maintenance time period T2 when the engine 15 rotates at a predetermined number of revolutions N1 or higher for a predetermined time period T1 or more, the throttle 64 (See FIG. 4) is opened at a predetermined opening θ1 or more for a predetermined time period T1 or more, the throttle 64 is closed and the steering wheel 28 is turned to the left or right more than a predetermined angle.

When the throttle is closed to turn the steering wheel 28 (See FIG. 4) in order to avoid an obstacle appearing in front of the boat hull 11 (See FIG. 1), the amount of the jet stream is reduced. Therefore, the maneuverability is deteriorated. Thus, under certain conditions, the number of revolutions of the engine is raised to a predetermined number of revolutions to increase the amount of the jet stream.

In this case, when the throttle 64 is closed in order to perform driving at a slow speed such as during entry into a port, when the number of revolutions of the engine is reduced, it is not necessary to increase the number of revolutions Ne of the engine. Also, since it is the maneuverability that matters, it is not necessary to increase the number of revolutions of the engine when the steering wheel 28 is not turned.

Accordingly, when the engine 15 rotates at a predetermined number of revolutions N1 or higher for a predetermined time period T1 or more, and the throttle 64 (See FIG. 4) is opened at a predetermined opening θ1 or more for a predetermined time period T1 or more, the throttle 64 is closed and the steering wheel 28 is turned to the left or right more than a predetermined angle, the above-described condition has been set.

Thereby, only when necessary, the number of revolutions Ne of the engine can be raised to a predetermined number of revolutions (maintenance number of revolutions N2).

In other words, a control unit 74 (See FIG. 4) is provided which raises the number of revolutions Ne of the engine to a predetermined number of revolutions (maintenance number of revolutions N2) and maintains it only for a predetermined maintenance time period T2, whereby an amount of jet stream is secured. Thus, the steering response of the jet propulsion boat 10 (See FIG. 1) can be improved.

Figure 11:
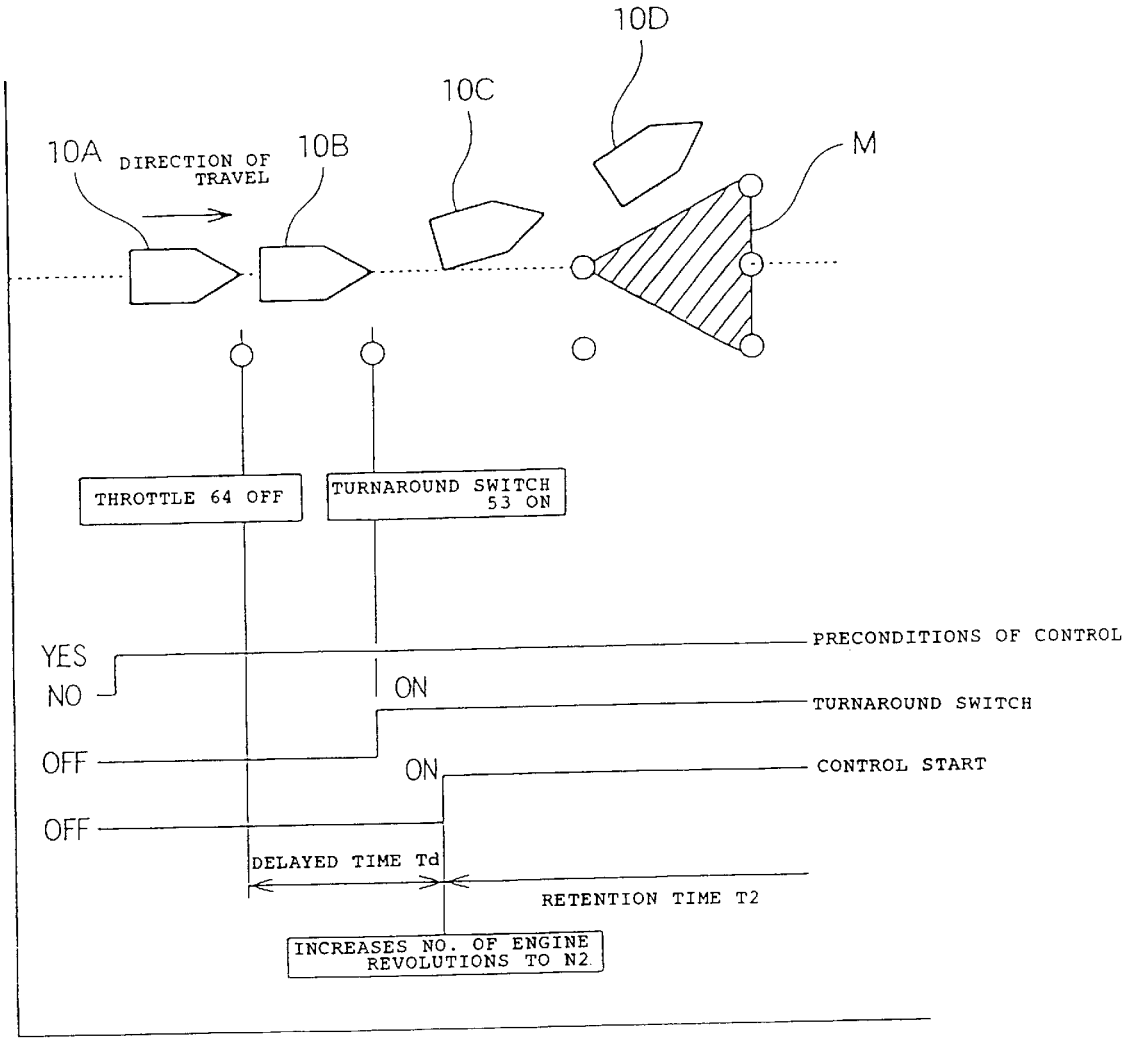
FIG. 11 is an operation explanatory view for a jet propulsion boat onto which a display device according to the present invention has been mounted.

FIG. 11 is an operation explanatory view of a jet propulsion boat onto which a display device according to the present invention has been mounted. In this respect, the figure of the jet propulsion boat 10 which moves with elapsed time is indicated by the jet propulsion boat 10A to 10D.

In the jet propulsion boat 10A, it is assumed to be under navigation in a state in which the predetermined number of revolutions N1 and the predetermine opening θ1 has been exceeded as shown in FIG. 10 and in a state in which the precondition for control for more than the predetermined time period T1 has been satisfied. At the time, an avoidance buoy M is detected, and the need for avoiding this avoidance buoy M becomes pressing.

In the jet propulsion boat 10B, in order to avoid the avoidance buoy M, the throttle 64 is closed to use the steering handle 28 (See FIG. 4) for a steering operation. In the jet propulsion boat 10B; however, as described above, the direction cannot be changed without a jet water stream. Thus, when the throttle 64 is turned OFF and the steering switch 53 is turned ON, after a lapse of a predetermined delay time period Td, the number of revolutions Ne of the engine is raised to N2 to generate a jet water stream (control start). In this respect, as regards the OFF timing of the throttle 64 and the ON timing of the steering switch 53, whichever is earlier, there is no problem.

Also, since it is a ship, which navigates in a sliding state in 10B, the jet propulsion boat sideslips frequently. Accordingly, to perform a control start after a predetermined delay time period is preferable in order to efficiently steer the boat hull 11 (See FIG. 1).

The jet propulsion boat starts changing the direction in 10C. As a result, the jet propulsion boat can avoid the avoidance buoy M in 10D at the driver's will.

Figures 12A, 12B, 12C, 12D, 12E:
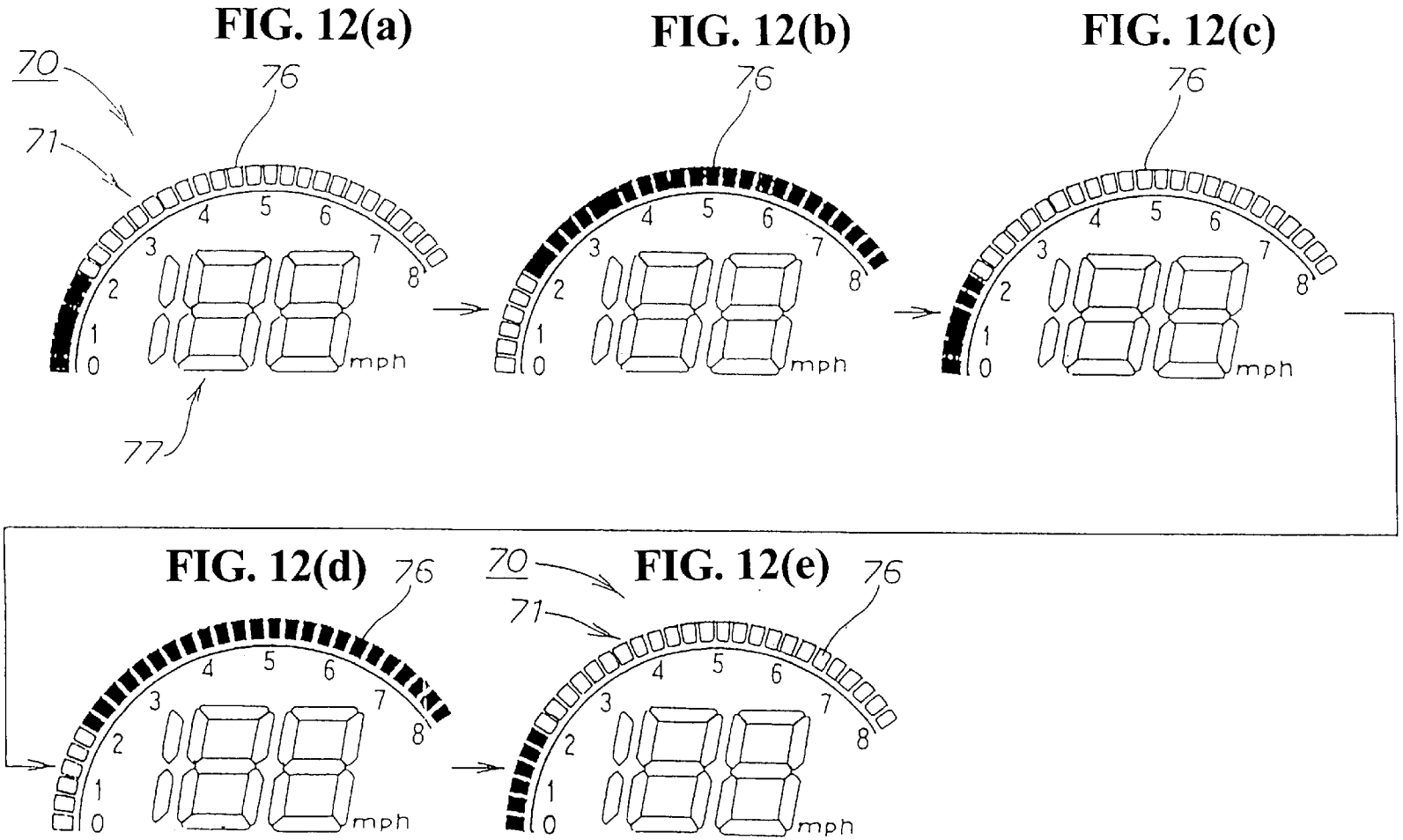
FIG. 12 is an explanatory view for a display pattern for a display device of a transportation means according to the present invention.

FIGS. 12(*a*) to 12(*e*) are explanatory views for display patterns of the display device of the transportation means according to the present invention.

FIG. 12(*a*) shows a display pattern of a tachometer 67 in the display device 70 under navigation (hereinafter, referred to as "ordinary state"), and shows that when the number of revolutions Ne of the engine is raised to 2000 rpm, black is indicated between 0 and 2, and white is indicated between 2 and 8.

FIGS. 12(*b*) to 12(*e*) show display patterns of the tachometer 67 under control (hereinafter, referred to as "non-ordinary state"), and the tachometer 67 of a liquid crystal display unit (liquid crystal device 71) reverses and blinks.

More specifically, when it shifts from the ordinary state to the non-ordinary state, a white-and-black display of the liquid crystal display unit (liquid crystal device 71) is reversed. A white-indicated portion in the ordinary state is caused to reverse and blink in the order of black-white-black in the non-ordinary state, and a black-indicated portion in the ordinary state is caused to reverse and blink in the order of white-black-white in the non-ordinary state.

In other words, in the transportation means (jet propulsion boat 10) equipped with the liquid crystal display unit (liquid crystal device 71) displaying the operation information, ordinary movement of the transportation means is regarded as the ordinary state. When the need arises for abruptly reducing a speed of the transportation means or abruptly changing the direction of the transportation means, and the like are distinguished as a non-ordinary state, the liquid crystal display unit (liquid crystal device 71) reverses a white-and-black display thereof when the transportation means shifts from the ordinary state to the non-ordinary state.

When the transportation means (jet propulsion boat 10) shifts from the ordinary state to the non-ordinary state, the white-and-black display of the liquid crystal display unit (liquid crystal device 71) is caused to reverse, whereby it is possible to sensitively and directly notify the driver that the transportation means is in a non-ordinary state. As a result, it becomes easier to recognize that the boat hull 11 is in a non-ordinary state.

Also, in other words, a white-displayed portion in the ordinary state is caused to reverse and blink in the order of black-white-black in the non-ordinary state, and a black-displayed portion in the ordinary state is caused to reverse and blink in the order of white-black-white in the non-ordinary state.

In the non-ordinary state, reversing and blinking is caused to thereby strongly give the impression on the driver that the transportation means (jet propulsion boat 10) is in the non-ordinary state.

Figure 13:
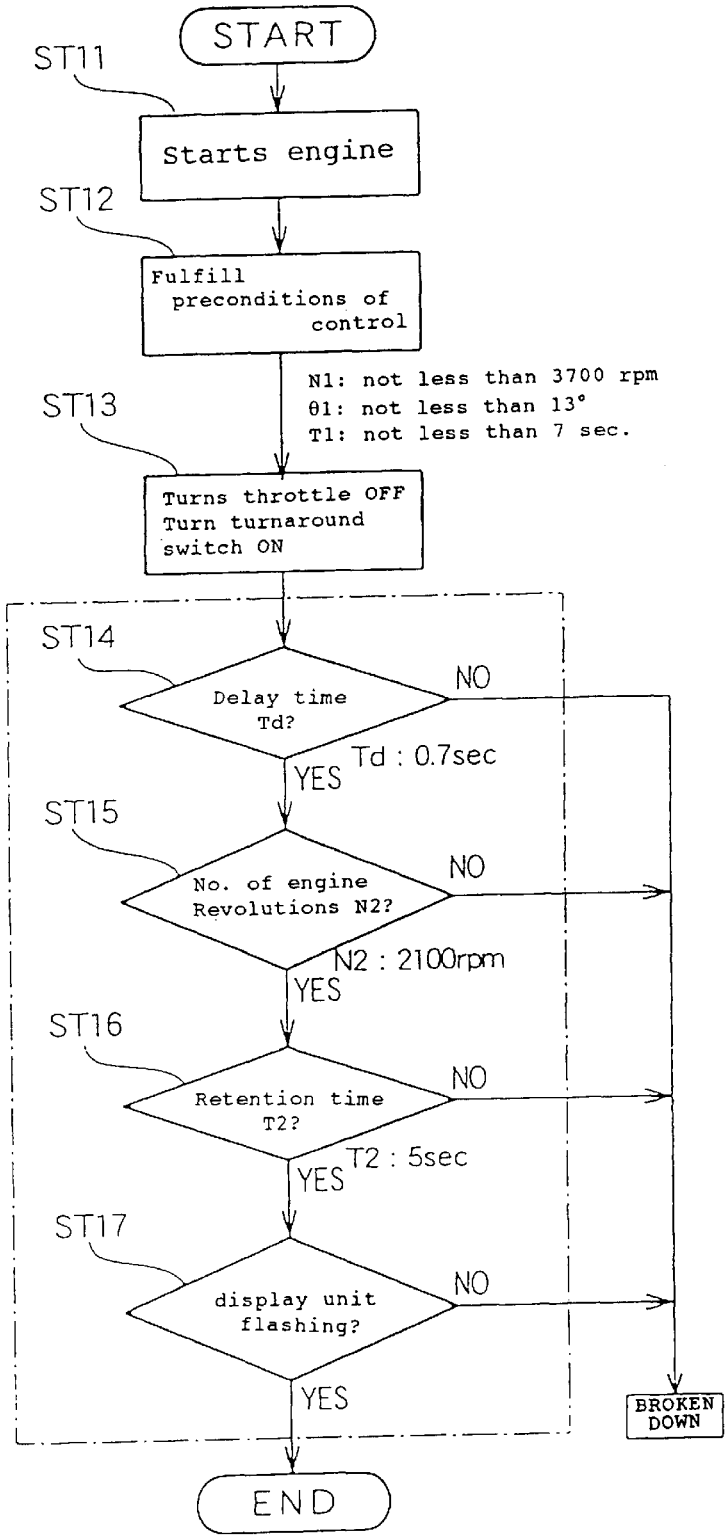
FIG. 13 is an explanatory view showing a start-up inspection procedure of a jet propulsion boat onto which a display device according to the present invention has been mounted.

FIG. 13 is an explanatory view showing a start-up inspection procedure for the jet propulsion boat onto which a display device according to the present invention has been mounted. In this respect, STxx designates a step No. (for symbols, refer to FIG. 4).

ST11: Start the engine 15 (See FIG. 1).

ST12: The precondition for control is satisfied. That is, maintains at a predetermined number of revolutions N1 of 3700 rpm or over, and at a predetermined opening θ1 of 13° or over for a predetermined time period of 2 sec or over.

ST13: Turn OFF the throttle 64, and turn ON the steering switch 53.

ST14: Delay time period Td is normal (normal at Td=0.7 sec)? If YES, the sequence will proceed to ST15. If NO, the control unit 74 may be out of order.

ST15: Is the number of revolutions Ne of the engine raised to N1=2100rpm? If YES, the sequence will proceed to ST16. If NO, the solenoid 62, the intake air passage 63 or a throttle link 47 (See FIG. 3) may be out of order.

ST16: Maintenance time period T2 is normal (normal at Td=7 sec)? If YES, the sequence will proceed to ST17. If NO, the control unit 74 may be out of order.

ST17: If NO, the display device 70 blinks? If YES, finish the start-up inspection. If NO, the display device 70, the steering switch 53 or the throttle position sensor 66 may be out of order.

Figure 14:
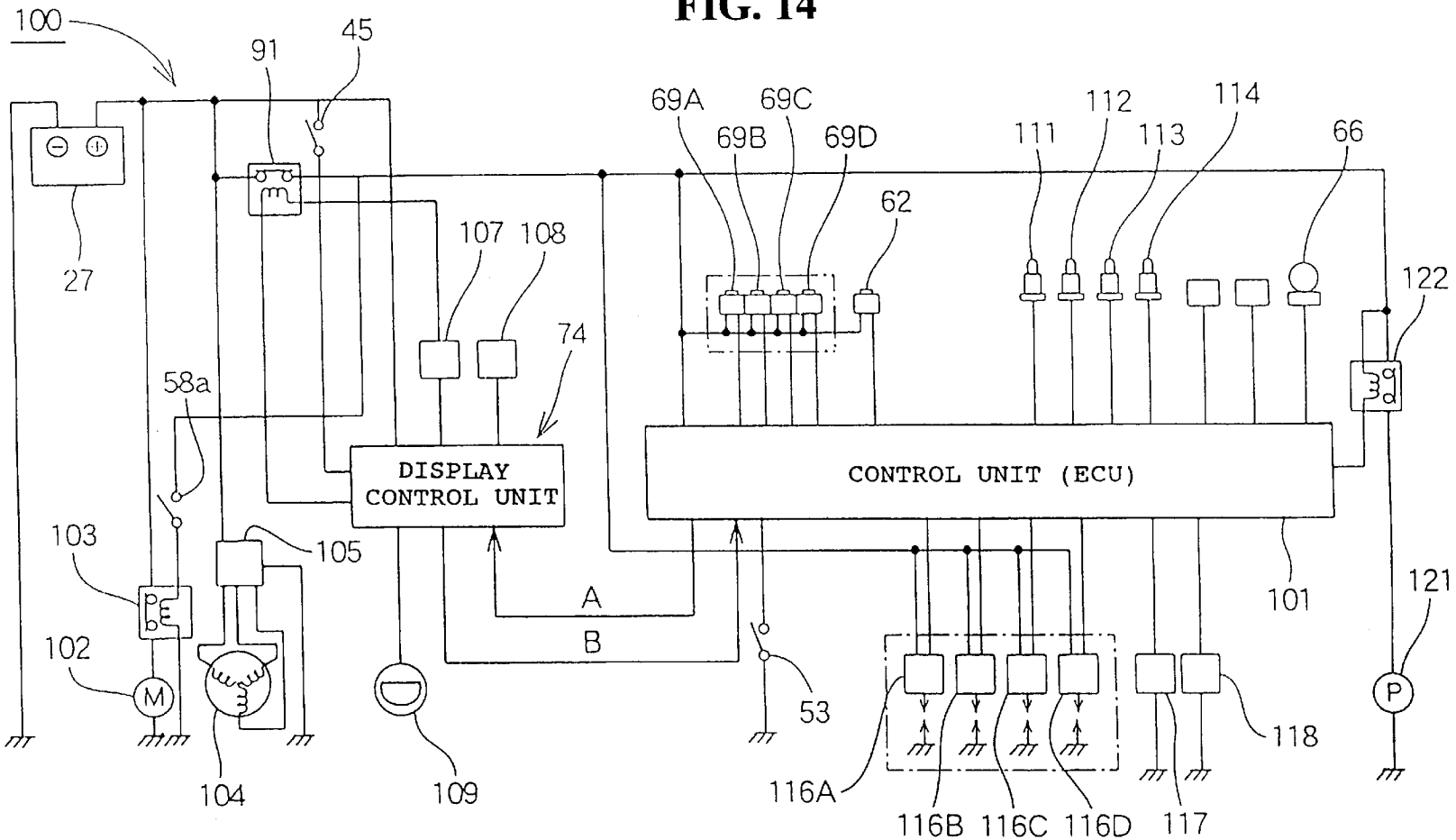
FIG. 14 is a control system view for a jet propulsion boat onto which a display device according to the present invention has been mounted.

FIG. 14 is a view showing a control system for a jet propulsion boat onto which a display device according to the present invention has been mounted.

The control system 100 for the jet propulsion boat includes a battery 27, which is a power supply source. An injector 69 (displayed as "injector 69A to 69D") is provided for the fuel injection system 61 (See FIG. 4). The control system 100 also includes a main relay 91, a display control unit 74 mounted on the display device 70 (See FIG. 5), and a control unit (ECU) 101 to be controlled by the engine 15 (See FIG. 1).

In FIG. 14, reference numeral 102 designates a starter, reference numeral 103 designated a starter relay for turning the starter 102 ON/OFF, reference numeral 104 is a generator, reference numeral 105 is a regulator for regulating voltage generated by the generator, reference numeral 107 is a buzzer connected to the display control unit 74, reference numeral 108 is a speed sensor connected to the display control unit 74, reference numeral 109 is a fuel sensor connected to the display control unit 74, reference numeral 111 is a temperature sensor connected to the control unit (ECU) 101, reference numeral 112 is a water temperature sensor connected to the control unit (ECU) 101, reference numeral 113 is an exhaust temperature detection sensor connected to the control unit (ECU) 101, reference numeral 114 is an oil temperature sensor for detecting the engine oil temperature by connecting to the control unit (ECU) 101, reference numerals 116A to 116D are ignition system members (ignition plug and ignition coil), reference numeral 117 is an oil pressure sensor, reference numeral 118 is a knock sensor for detecting knocking of the engine 15, reference numeral 121 is a fuel pump, and reference numeral 122 is a relay for turning ON/OFF the fuel pump.

A flow indicated by an arrow A indicates engine oil information, temperature information, fuel information, engine number of revolutions information, warning lamp display information, and OTS (Off Throttle Steering System) which are transmitted from the control unit (ECU) 101 to the display control unit 74.

Also, a flow indicated by an arrow B indicates lock information and limited operation information which are transmitted from the display control unit 74 to the control unit (ECU) 10.

In this respect, in the embodiments, it has been arranged such that as shown in FIG. 12, a white-displayed portion in the ordinary state is caused to reverse and blink in the order of black-white-black in the non-ordinary state, and a black-displayed portion in the ordinary state is caused to reverse and blink in the order of white-black-white in the non-ordinary state. However, the present invention is not limited thereto, but when for example, color liquid crystal is used for the liquid crystal display unit, gradations of color do not matter.

In the embodiments, the description has been made of the display device under OTS control of the jet propulsion boat as shown in FIG. 12, as an example of the non-ordinary state, but the present invention is not limited thereto, but the non-ordinary state may be during operation of ABS of the vehicle, during operation of the traction control, or during operation of an attitude control device. Also, it may be when important parts (engine, driving system, steering system and the like) are out of order.

The present invention exhibits the following effects due to the above-described structure.

According to a first aspect of the present invention, an ordinary movement of the transportation means is regarded as an ordinary state. When the need arises for abruptly reducing the speed of the transportation means or abruptly changing the direction of the transportation means, and the like it is regarded as a non-ordinary state. A liquid crystal display unit reverses a white-and-black display thereof when the transportation means shifts from the ordinary state to the non-ordinary state. Therefore, the driver can be sensitively and directly notified that the transportation means is in a non-ordinary state. As a result, it becomes easier to recognize that the transportation means is in a non-ordinary state.

According to a second aspect of the present invention, a white-displayed portion in an ordinary state is caused to reverse and blink in the order of black-white-black in a non-ordinary state, and a black-displayed portion in the ordinary state is caused to reverse and blink in the order of white-black-white in the non-ordinary state. Therefore, it is possible to strongly give the impression on the driver that the transportation means is in the non-ordinary state.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A display device for a transportation means, comprising:

a liquid crystal display unit, said liquid crystal display unit displaying operation information, an ordinary movement of said transportation means is regarded as an ordinary state, and when a need arises for abruptly reducing a speed of said transportation means or abruptly changing a direction of said transportation means, it is regarded as a non-ordinary state, wherein said liquid crystal display unit includes a white-and-black display having a white-displayed portion and a black-displayed portion, and when said transportation means shifts from the ordinary state to the non-ordinary state, the white-displayed portion turns black and the black-displayed portion turns white.

2. The display device for a transportation means according to claim 1, wherein the white-displayed portion in said ordinary state is caused to reverse and blink in the order of black-white-black in the non-ordinary state, and the black-displayed portion in said ordinary state is caused to reverse and blink in the order of white-black-white in the non-ordinary state.

3. The display device for a transportation means according to claim 1, wherein when said transportation means is in the ordinary state, the black-displayed portion indicates the operation information, and when said transportation means is in the non-ordinary state, said black-displayed portion is caused to reverse and blink in the order of white-black-white.

4. The display device for a transportation means according to claim 1, wherein when said transportation means is in the ordinary state, the white-displayed portion indicates a non-operation information portion, and when said transportation means is in the non-ordinary state, said white-displayed portion is caused to reverse and blink in the order of black-white-black.

5. A transportation means, comprising:

a body;

a steering handle mounted for rotation on said body;

an engine mounted to said body for propelling said body;

a device for measuring an operation of said transportation means; and a liquid crystal display unit, said liquid crystal display unit displaying operation information measured by said device for measuring an operation of said transportation means, an ordinary operation of said transportation means is regarded as an ordinary state, and a non-ordinary operation of said transportation means is regarded as a non-ordinary state, wherein said liquid crystal display unit includes a white-and-black display having a white-displayed portion and a black-displayed portion, and when said transportation means shifts from the ordinary state to the non-ordinary state, the white-displayed portion turns black and the black-displayed portion turns white.

6. The transportation means according to claim 5, wherein the white-displayed portion in said ordinary state is caused to reverse and blink in the order of black-white-black in the non-ordinary state, and the black-displayed portion in said ordinary state is caused to reverse and blink in the order of white-black-white in the non-ordinary state.

7. The transportation means according to claim 5, wherein when said transportation means is in the ordinary state, the black-displayed portion indicates the operation information, and when said transportation means is in the non-ordinary state, said black-displayed portion is caused to reverse and blink in the order of white-black-white.

8. The transportation means according to claim 5, wherein when said transportation means is in the ordinary state, the white-displayed portion indicates a non-operation information portion, and when said transportation means is in the non-ordinary state, said white-displayed portion is caused to reverse and blink in the order of black-white-black.

9. A transportation means, comprising:

a body;

a steering handle mounted for rotation on said body;

an engine mounted to said body for propelling said body;

a device for measuring an operation of said transportation means; and a liquid crystal display unit, said liquid crystal display unit displaying operation information measured by said device for measuring an operation of said transportation means, an ordinary operation of said transportation means is regarded as an ordinary state, and a non-ordinary operation of said transportation means is regarded as a non-ordinary state, wherein said liquid crystal display unit reverses a white-and-black display thereof when said transportation means shifts from the ordinary state to the non-ordinary state, and said device for measuring an operation of said transportation means includes a steering angle detector and a tachometer, and said non-ordinary operation occurs when said steering angle detector detects a predetermined steering angle of said steering handle and/or said tachometer detects a predetermined number of revolutions of the engine.

10. The transportation means according to claim 9, wherein a white-displayed portion in said ordinary state is caused to reverse and blink in the order of black-white-black in the non-ordinary state, and a black-displayed portion in said ordinary state is caused to reverse and blink in the order of white-black-white in the non-ordinary state.

11. The transportation means according to claim 9, wherein when said transportation means is in the ordinary state, a black-displayed portion indicates the operation information, and when said transportation means is in the non-ordinary state, said black-displayed portion is caused to reverse and blink in the order of white-black-white.

12. The transportation means according to claim 9, wherein when said transportation means is in the ordinary state, a white-displayed portion indicates a non-operation information portion, and when said transportation means is in the non-ordinary state, said white-displayed portion is caused to reverse and blink in the order of black-white-black.

13. A display device for a transportation means, comprising:

a liquid crystal display unit, said liquid crystal display unit displaying operation information measured by a device for measuring an operation of the transportation means, an ordinary operation of the transportation means is regarded as an ordinary state, and a non-ordinary operation of the transportation means is regarded as a non-ordinary state, wherein said liquid crystal display unit includes a white-and-black display having a white-displayed portion and a black-displayed portion, and when the transportation means shifts from the ordinary state to the non-ordinary state, the white-displayed portion turns black and the black-displayed portion turns white.

14. The display device for a transportation means according to claim 13, wherein the white-displayed portion in said ordinary state is caused to reverse and blink in the order of black-white-black in the non-ordinary state, and the black-displayed portion in said ordinary state is caused to reverse and blink in the order of white-black-white in the non-ordinary state.

15. The display device for a transportation means according to claim 13, wherein when the transportation means is in the ordinary state, the black-displayed portion indicates the operation information, and when the transportation means is in the non-ordinary state, said black-displayed portion is caused to reverse and blink in the order of white-black-white.

16. The display device for a transportation means according to claim 13, wherein when the transportation means is in the ordinary state, the white-displayed portion indicates a non-operation information portion, and when the transportation means is in the non-ordinary state, said white-displayed portion is caused to reverse and blink in the order of black-white-black.

17. A display device for a transportation means, comprising:

a liquid crystal display unit, said liquid crystal display unit displaying operation information measured by a device for measuring an operation of the transportation means, an ordinary operation of the transportation means is regarded as an ordinary state, and a non-ordinary operation of the transportation means is regarded as a non-ordinary state, wherein said liquid crystal display unit reverses a white-and-black display thereof when the transportation means shifts from the ordinary state to the non-ordinary state, and the device for measuring an operation of the transportation means includes a steering angle detector and a tachometer, and said non-ordinary operation occurs when the steering angle detector detects a predetermined steering angle of a steering handle of the transportation means and/or the tachometer detects a predetermined number of revolutions of an engine of the transportation means.

18. The display device for a transportation means according to claim 17, wherein a white-displayed portion in said ordinary state is caused to reverse and blink in the order of black-white-black in the non-ordinary state, and a black-displayed portion in said ordinary state is caused to reverse and blink in the order of white-black-white in the non-ordinary state.

19. The display device for a transportation means according to claim 17, wherein when the transportation means is in the ordinary state, a black-displayed portion indicates the operation information, and when the transportation means is in the non-ordinary state, said black-displayed portion is caused to reverse and blink in the order of white-black-white.

20. The display device for a transportation means according to claim 17, wherein when the transportation means is in the ordinary state, a white-displayed portion indicates a non-operation information portion, and when the transportation means is in the non-ordinary state, said white-displayed portion is caused to reverse and blink in the order of black-white-black.

* * * * *